US006085560A

United States Patent [19]

Dalton, Jr.

[11] Patent Number: 6,085,560

[45] Date of Patent: Jul. 11, 2000

[54] AXIAL PIN TUMBLER LOCK WITH ELECTRONIC FEATURES

[75] Inventor: Robert E. Dalton, Jr., Maldin, S.C.

[73] Assignee: Compx International, Inc., Mauldin, S.C.

[21] Appl. No.: 09/237,717

[22] Filed: Jan. 26, 1999

Related U.S. Application Data

[60] Provisional application No. 60/104,520, Oct. 16, 1998.

[51] Int. Cl.[7] ..... E05B 27/08; E05B 49/00

[52] U.S. Cl. ..... 70/278.3; 70/404; 70/491

[58] Field of Search ..... 70/278.2, 278.3, 70/283, 283.1, 404, 491, 277, 279.1, DIG. 30, DIG. 49

[56] References Cited

U.S. PATENT DOCUMENTS

| | | | |
|---|---|---|---|
| 3,878,700 | 4/1975 | Lopez | 70/491 |
| 4,078,405 | 3/1978 | Steinbach | 70/491 |
| 4,090,175 | 5/1978 | Hart | 70/278.2 X |
| 4,712,398 | 12/1987 | Clarkson et al. | 70/283 X |
| 4,858,456 | 8/1989 | McGee, Sr. | 70/491 |
| 5,771,722 | 8/1998 | DiVito et al. | 70/283 X |
| 5,791,177 | 8/1998 | Bianco | 70/283.1 |
| 5,819,563 | 10/1998 | Bianco | 70/389 |

FOREIGN PATENT DOCUMENTS

| | | | |
|---|---|---|---|
| 80996 | 7/1920 | Austria | 70/278.3 |
| 86491 | 8/1983 | European Pat. Off. | 70/278.3 |
| 1369541 | 10/1974 | United Kingdom | 70/491 |
| 2225371 | 5/1990 | United Kingdom | 70/278.3 |

*Primary Examiner*—Lloyd A. Gall
*Attorney, Agent, or Firm*—Banner & Witcoff, Ltd.

[57] ABSTRACT

A pin tumbler mechanical lock includes an electronic component incorporated in the key which connects to an axial lead aligned to mechanically engage the spring biased contact of the key whereby in order to operate the lock both the mechanical pin tumblers and the electronic signal provided by the key are necessary.

9 Claims, 2 Drawing Sheets

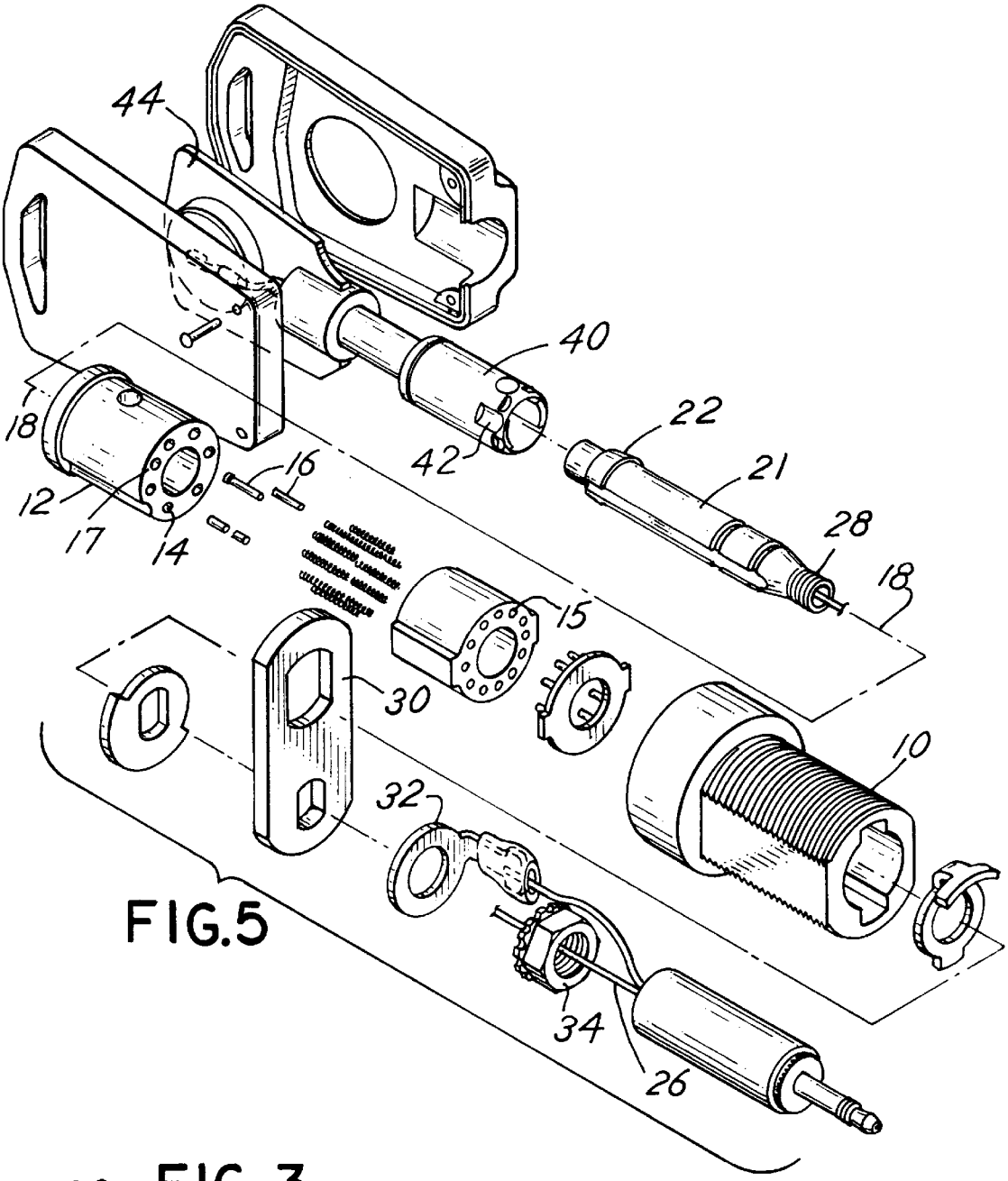
FIG.5
FIG.3
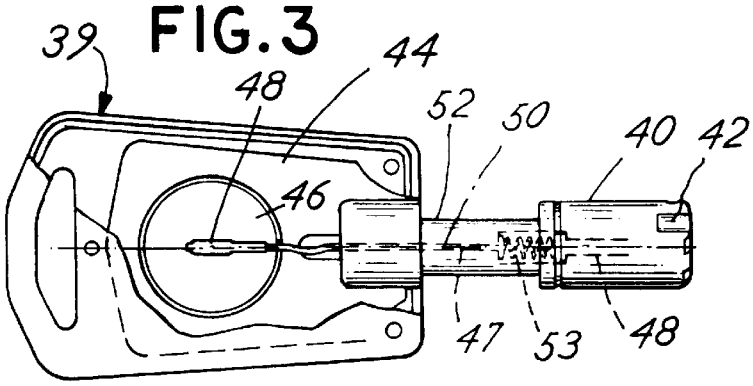
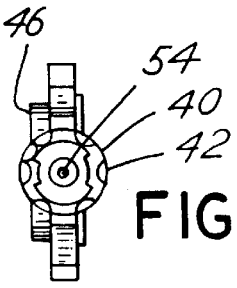
FIG.4

AXIAL PIN TUMBLER LOCK WITH ELECTRONIC FEATURES

This appln claims the benefit of U.S. Provisional application No. 60/104,520 filed Oct. 16, 1998.

BACKGROUND OF THE INVENTION

This invention relates to a lock set including an axial pin tumbler lock and a mechanical key with an electronic identification chip.

Axial pin tumbler locks have been used for many years, and a variety of such locks have been manufactured. Typical of such locks is the pin tumbler lock disclosed in U.S. Pat. No. 3,451,819 issued Nov. 24, 1970 to W. J. Kerr for an Axial Pin Tumbler Lock wherein the lock is operated by a single key. Monahan in U.S. Pat. No. 3,422,646 issued Jan. 21, 1969, discloses a pin tumbler lock which permits resetting of the lock. Another type of resettable axial pin tumbler lock is disclosed in Reissue Patent No. 28,319. An axial pin tumbler lock which may be mechanically reset to provide many distinct combinations is also disclosed in U.S. Pat. No. 4,233,828. Yet another resettable axial pin tumbler lock is disclosed in McGee, U.S. Pat. No. 4,858,456. Thus, there are numerous types of axial pin tumbler locks available. Such locks are especially popular for use in vending machines and the like. Such locks are more useful for vending machines provided the combination of the lock may be altered from time to time to improve the security of the lock.

Recently, enhanced security requirements have led to the development of locks which incorporate the mechanical characteristics of tumblers which interact with a bitted key and the security of an electronic combination associated with a chip carried on the key for the lock. Typically a lock with a chip incorporated on the key will, upon insertion of the key into the lock, provide an appropriate electronic combination or signal to release a lock bolt as well as a mechanical combination to align the tumblers of the lock to permit actuation thereof by the key. Gokcebay et al. in U.S. Pat. No. 5,367,295 entitled "Conventional Mechanical Lock Cylinders and Keys with Electronic Access Control Feature" discloses a combination mechanical and electronic access controlled lock. In U.S. Pat. No. 5,367,295, the key is inserted into a keyway. A ground connection is made with a cylinder and a spring loaded contact within the lock engages the key in a manner which enables the chip mounted on the key to be "read." Each of the reference patents discussed above is incorporated herewith by reference.

With the advancement of lock design and the concept of combining electronic as well as mechanical features in a single lock, there has remained a desire to provide a construction capable of changing the combination of the lock, mechanically as well as electronically. Further, there has remained a desire to provide a mechanical and electrical lock set construction which is easy to manufacture, may be incorporated in existing lock designs and which may be adapted for use with axial pin tumbler locks. These and other incentives inspired the present invention.

SUMMARY OF THE INVENTION

Briefly, the present invention comprises an axial pin tumbler lock of the type which includes a housing with a centerline axis and a plurality of tumbler bores or passages parallel to and spaced radially from the axis. A rotatable plug is mounted in the housing and includes plug bores alignable along a shear line with the housing bores. Axial pin tumblers are slidably mounted in the bores. A barrel-shaped key is fitted into the lock to drive the tumblers into appropriate alignment and permit rotation of the plug with respect to the housing by aligning the pin tumblers along the shear line which is transverse to the centerline axis of the lock. The key further includes an identification chip or memory cell. The chip is electrically connected to a biased, centerline axis pin retained within the key barrel. The biased pin is positioned to engage a coaxial lead or contact mounted within the plug of the mechanical lock and extending along the centerline axis. Upon insertion of the key into the housing of the mechanical lock, the pin associated with the key engages the contact associated with the rotatable plug. This closes an electronic circuit through the lock which is coupled to electronic recognition and control circuitry and also translates the pin tumblers to permit rotation of the plug. The electronic control circuitry may release the bolt or otherwise provide a recognition signal which enables operation of the lock provided the correct mechanical key has been inserted into the lock. A ground wire also connects to the barrel or housing of the lock.

Thus it is an object of the invention to provide an improved combination electronic and mechanical, axial pin tumbler lock.

It is a further object of the invention to provide an axial pin tumbler lock which may be settable to different mechanical combinations and which also includes an identification chip or memory cell which may be settable.

Another object of the invention is to provide an axial pin tumbler key of the type formed from an annular barrel and further including a biased centerline or axial pin which is electrically connected to a chip mounted on the key.

Another object of the invention is to provide an axial pin tumbler lock which includes an electronic security feature wherein the electronic security feature may be incorporated into a myriad of different types of axial pin tumbler locks.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is a side elevation of a key of the type useful in combination with the lock of FIG. 1;

FIG. 4 is a front elevation of the key of FIG. 3; and

FIG. 5 is an exploded isometric view of the key and lock combination of the invention.

DESCRIPTION OF THE PREFERRED EMBODIMENT

Figure 1:
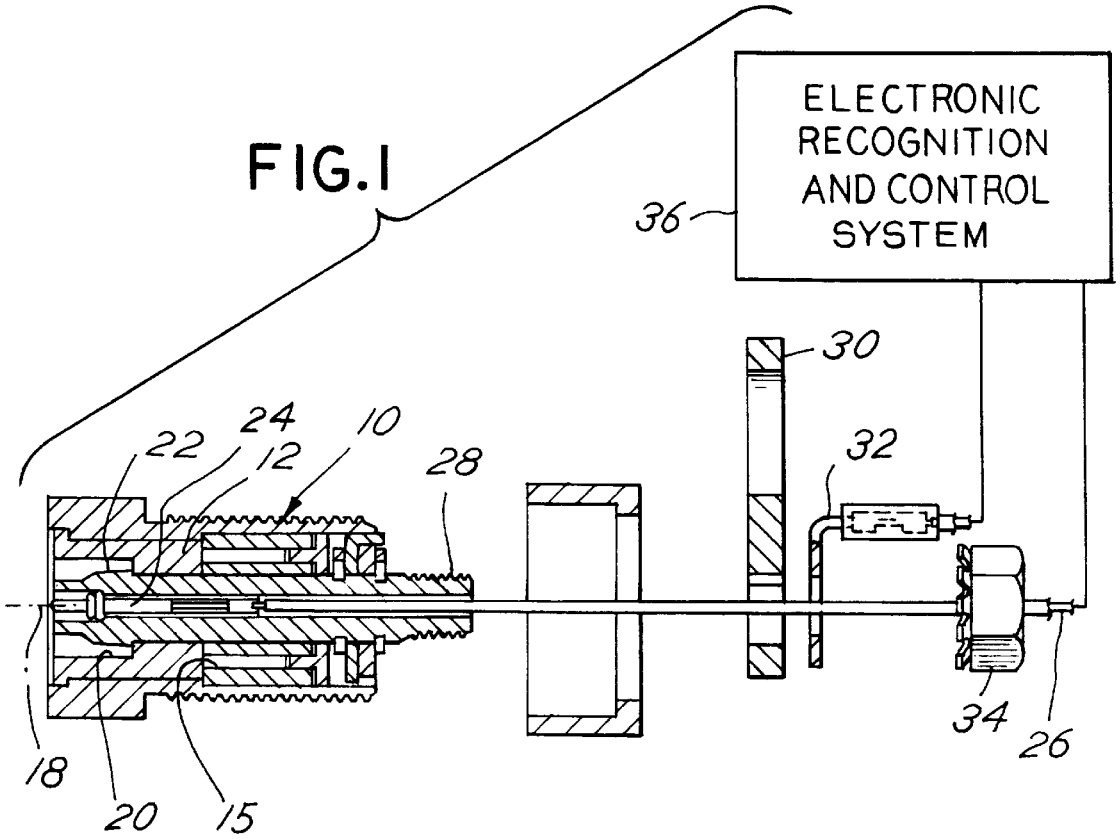
FIG. 1 is an exploded, side view of a typical axial pin tumbler lock incorporating the electronic security features of the invention.
Figure 2:
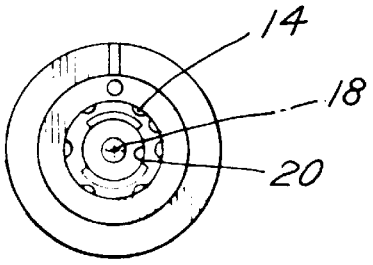
FIG. 2 is a front elevation of the lock of FIG. 1.

The lock set of the invention comprises, in combination, a lock body depicted in FIGS. 1 and 2 and a key depicted in FIGS. 3 and 4. The combination is illustrated in FIG. 5. The lock body of FIGS. 1 and 2 is an axial pin tumbler lock. It includes a housing 10 which may be fixed or attached to a cabinet wall, for example. Within the housing 10 is a rotatable plug 12. The plug 12 includes axial bores 14 which can be aligned with axial bores 15 in the housing 10. Bores 14, 15 are radially spaced from a centerline axis 18. Axial pin tumblers 16 are positioned in the bores 14 and are slidable in a direction parallel to the centerline axis 18 of the housing 10.

The housing 10 further includes an annular opening 20 for receipt of the barrel of the key described below. The annular opening 20, as shown in FIG. 2, permits access of the key to engage the tumblers 16 arranged in the various axial bores 14 within the housing 10 and plug 12. The plug 12 includes an axial rod 21 with a forward projection 22 which extends along the axis 18 and includes a center contact member 24.

The rod 21 of plug 12 further includes a projecting stud 28 which cooperates with a bolt or cam 30. A ground wire connection 32 is provided to connect to the lock itself. A nut 34 holds the cam 30 on the stud 28. The contact member 24 extends axially for the full length of the housing 10 and is connected to a lead wire 26. Contact 24 is insulated electrically from the rod 21 and other lock components. The lead wire 26 connects to an electronic recognition and control system 36 which recognizes a signal from a chip 46 maintained on a key as depicted in FIGS. 3 and 4 described below. The control circuitry 36 may be utilized to operate a solenoid or some other mechanism (not shown) to release the cam 30. The recognition system 36 may, alternatively, be tied into some type of alarm system or other electronic device which will indicate whether an appropriate key is being used in the lock.

FIGS. 3 and 4 illustrate the key 39 in greater detail. The key 39 is comprised of an annular barrel 40 which has axial slots 42 defined in its outer surface for engagement with appropriate pin tumblers 16. The barrel 40 is connected to a key handle 44. Mounted in the handle 44 is an electronic chip, for example, an EEPROM or some other type of chip 46. The EEPROM or chip 46 is connected by insulated lead 47 to a spring-loaded, insulated contact pin 48 mounted coaxially on the centerline axis 50 within the barrel 40. The spring-loaded contact pin 48 thus includes a cylindrical housing 52 with a spring 53 therein for biasing a movable pin contact 54 and for conducting between lead 47 and pin 48.

When the assembly is utilized, the barrel 40 is inserted into the annular opening 20 so that the bitted slots 42 will appropriately align pin tumblers 16 to effect appropriate alignment along a shear plane 17 in FIG. 1. Simultaneously the biased key pin 48 engages the electrically insulated barrel contact 24 to complete an electronic circuit. The circuit provides for connection of the electronic chip 46 and the logic associated with the chip 46 to the sensing circuitry 36. If the appropriate pre-programnued signal is recognized by the control circuitry 36, then the control circuitry 36 will enable operation of the cam 30, for example, by release of a solenoid or some other release mechanism or by forbearance in actuation of an alarm.

With the present invention, it is possible to utilize numerous types of chips, for example, a programmable chip such as an EEPROM may be carried by the key depicted in FIGS. 3 and 4. The key in FIGS. 3 and 4, as well as the axial pin tumbler lock body depicted in FIGS. 1 and 2, may be any one of a variety of multiple types of axial pin tumbler locks of this nature including locks of the type in the referenced prior art which is incorporated herewith by reference. The combination of the spring-loaded contact pin 48, the electronic chip 46, the contact member 24 and the leads thereto with the mechanical lock provide for a duality of security. The lock thus has both electronic as well as mechanical security. The lock is an electromechanical lock which may be pre-programmed. Moreover, both the electronic capability as well as the mechanical features of the lock permit it to be reprogrammed or resettable such as depicted in the mechanical aspect of the invention with respect to the referenced prior art patents. The combination provides for a very broad based combination in which to utilize the benefits of a mechanical axial pin tumbler lock as well as electronic lock. Thus while there has been set forth a preferred embodiment of the invention, it is to be understood that the invention is to be limited only by the following claims and equivalents thereof.

What is claimed is:

1. A combination pin tumbler mechanical lock and electronic lock set comprising in combination:

a lock including a housing with an annular key opening at a front end, a centerline axis, a plurality of axial bores in the housing radially spaced from the axis and aligned with the key opening, a rotatable plug in the housing, said plug rotatable about the axis and including axial bores alignable with the axial bores of the housing, said plug and said housing defining a shear plane transverse to the axis, a plurality of pin tumblers in the bores biased toward the front end for engagement by a key inserted into the lock housing to effect alignment of the tumblers along the shear plane to permit mechanical key actuated rotation of the rotatable plug by a bitted key inserted into the annular key opening and thus actuation of the lock;

said plug further including a separate center rod coaxial and co-rotatable with the plug, said rod including a contact member extending axially through the rod and electromechanically accessible at the front end of the rod; and a key comprising an annular barrel for congruent insertion in the key opening, said barrel including bitted key elements for mechanically engaging the pin tumblers to mechanically unlock the lock, said key barrel further including a spring biased axial pin contact in the barrel alignable with the contact member in the plug when the key is inserted in the housing to make an electromechanical contact therewith, said key further including an electronic identification chip affixed thereto, said chip electrically connected to the pin contact, said pin contact and the contact member in the housing defining a circuit when the key is inserted in the housing.

2. The set of claim 1 further including an electrical ground attached to the housing.

3. The set of claim 1 further including an electronic recognition circuit connected to the housing contact member.

4. The set of claim 1 wherein the pin contact and contact member are coaxial on the housing axis.

5. The set of claim 1 wherein the identification chip is programmable.

6. The set of claim 1 wherein the mechanical lock is a key change lock.

7. The set of claim 1 wherein the plug and key are coaxial and co-rotatable.

8. The set of claim 1 wherein the plug and key are electronically programmable.

9. The set of claim 1 wherein the identification chip is an EEPROM chip.

* * * * *